US006810827B2

(12) United States Patent
Hansen

(10) Patent No.: US 6,810,827 B2
(45) Date of Patent: Nov. 2, 2004

(54) RIGID HULL INFLATABLE BOAT WITH FOAM INSERT

(75) Inventor: William M. Hansen, Port Orchard, WA (US)

(73) Assignee: Safe Boats International, L.L.C., Port Orchard, WA (US)

( * ) Notice: Subject to any disclaimer, the term of this patent is extended or adjusted under 35 U.S.C. 154(b) by 60 days.

(21) Appl. No.: 10/696,420

(22) Filed: Oct. 29, 2003

(65) Prior Publication Data

US 2004/0083941 A1 May 6, 2004

Related U.S. Application Data

(63) Continuation of application No. 10/047,428, filed on Jan. 14, 2002, now abandoned

(60) Provisional application No. 60/261,350, filed on Jan. 12, 2001.

(51) Int. Cl.[7] ..... B63B 7/00

(52) U.S. Cl. ..... 114/345

(58) Field of Search ..... 114/345, 357, 114/219, 68, 123

(56) References Cited

U.S. PATENT DOCUMENTS

| | | | | |
|---|---|---|---|---|
| 2,959,146 A | | 11/1960 | Erkert | |
| 3,169,756 A | | 2/1965 | Miller | |
| 4,060,864 A | | 12/1977 | Woolworth | |
| 4,060,865 A | | 12/1977 | Woolworth | |
| 4,159,551 A | * | 7/1979 | Iwai | 114/345 |
| 4,287,624 A | | 9/1981 | Lowther | |
| 4,520,746 A | | 6/1985 | Walters et al. | |
| 4,807,556 A | | 2/1989 | Hillier | |
| 4,964,821 A | | 10/1990 | Tafoya | |
| 4,996,936 A | * | 3/1991 | Brundritt | 114/68 |
| 5,282,436 A | | 2/1994 | Hansen | |
| 5,647,297 A | | 7/1997 | Hansen | |
| 5,651,328 A | | 7/1997 | Elkington | |
| 5,870,965 A | | 2/1999 | Hansen | |
| 6,371,040 B1 | * | 4/2002 | Hemphill et al. | 114/219 |
| 6,460,477 B1 | * | 10/2002 | Hamilton et al. | 114/345 |

FOREIGN PATENT DOCUMENTS

| | | | |
|---|---|---|---|
| DE | 1 947 663 A | | 4/1970 |
| EP | 0 370 668 A | | 5/1990 |
| EP | 0 429 107 A1 | | 5/1991 |
| GB | 946811 | | 1/1964 |
| GB | 2 113 156 A | | 8/1983 |
| GB | 2196717 A | * | 5/1988 |
| GB | 2 196 717 A | | 5/1988 |
| JP | 61-207287 | | 9/1986 |
| WO | WO 01/26959 A | | 4/2001 |
| WO | WO 01/64508 A | | 9/2001 |

OTHER PUBLICATIONS

"R5," Schat Harding, undated (a single sheet showing one view of the R5 watercraft boat) [at least as early as Jan. 11, 2002].

"R6 Rescue Boat/Work Boat," Schat Watercraft, Inc., Data Sheet, Nov. 1990.

"Typical Midship Section," undated (a single sheet showing one view of an unknown watercraft boat).

"Watercraft's New Rescue Boat," *Safety at Sea*, Oct. 1988, pp. 10–11.

* cited by examiner

*Primary Examiner*—Stephen Avila
(74) *Attorney, Agent, or Firm*—Christensen O'Connor; Johnson Kindness PLLC

(57) ABSTRACT

A boat with an inflatable collar mounted on the sides of the hull. The inflatable collar extends outwardly from the sides of the hull so that it contacts and displaces an increasing volume of water as the boat lists. The inflatable collar is partially filled with foam and the foam inserts are sized so that the boat retains a sufficient righting moment for its intended purpose, even when the inflatable collar has lost its water- and air-tight integrity. The foam inserts may also be sized to provide the boat with sufficient buoyancy to ensure that the boat will float even if filled with water or capsized.

22 Claims, 4 Drawing Sheets

RIGID HULL INFLATABLE BOAT WITH FOAM INSERT

CROSS-REFERENCE TO RELATED APPLICATIONS

This application is a continuation of Application No. 10/047,428, filed Jan. 14, 2002, now abandoned, priority from the filing date of which is hereby claimed under 35 U.S.C. § 120, which prior application claims the benefit of U.S. Provisional Application No. 60/261,350, filed Jan. 12, 2001, and which applications are incorporated herein by reference.

FIELD OF THE INVENTION

The present invention relates to boats that are stabilized with buoyant stabilizing members. Specifically, the present invention relates to boats that have rigid hulls and an inflatable collar with a foam insert stabilizing member attached to the sides of the hulls and extending substantially around the perimeter of the hulls.

BACKGROUND OF THE INVENTION

It is very important to design smaller boats with flotation devices in the hull to ensure that the boat remains floating in case substantial water gets into the boat or the boat capsizes. Additionally, flotation devices provide the boat with added buoyancy, thus increasing carrying capacity and safety. The installation of flotation devices is especially important in the case of small boats that are designed for operation on rough waters, such as in the case of rescue boats.

Many prior art boat designs incorporate foam devices within the hull of the boat, as in U.S. Pat. No. 4,060,865 (Woolworth). Typically, the foam flotation members are incorporated directly within the hull structure itself. These boat designs are generally safer than designs that do not incorporate flotation devices within the hull.

Other prior art boat designs use inflatable cylinders to form the sides of the boat, as in the case of Zodiac® boats. The inflatable cylinders provide a high degree of stability to the boat, but result in a loss of performance. Generally, prior art inflatable boat designs use inflatable cylinders as the sides of the boat and either a flexible floorboard or a rigid floorboard formed of wood or fiberglass. In operation, the cylinders serve as the running surface for the boat and remain in contact with the surface of the water; thus, a substantial wetted surface area and a significant amount of drag are created. This design also results in a very poor ride due to the fact that the boat tends to skip or bounce over the top of the waves. In addition, the inflatable cylinders are easily damaged and must constantly be inspected for tears, leaks, etc. Another disadvantage to inflatable boats is that typically the interior of the boat is very small, thus leaving little room for carrying equipment or passengers.

Another prior art design is a boat stabilized through the use of outboard foam stabilizing members. Generally, such prior art designs use a rigid, planing hull having a transom and a pair of curved sides extending forwardly from the transom to form the bow of the watercraft. The sides and bottom of the hull are joined to form a chine. Foam stabilizers for stabilizing the watercraft are mounted on the sides of the hull above the chine and extend from the transom along the length of the hull to the bow. The stabilizers extend outwardly from the sides of the hull so that they contact and displace an increasing volume of water as the boat lists. A disadvantage of such foam-stabilized boats is that the foam stabilizers are harder than the prior art inflatable boats with inflatable cylinders at the sides.

SUMMARY OF THE INVENTION

The present invention provides a safe, stable, high performance boat while reducing the disadvantages of prior art designs. The present invention's use of a rigid, planing boat hull combined with an exterior inflatable collar partially filled with foam results in these advantages without the disadvantages of typical inflatable boat designs. Furthermore, the inflatable collar is substantially out of contact with the surface of the water when the boat is at cruising speed. This decreases the wetted surface area of the boat when compared to inflatable boat designs, thus increasing performance. An auxiliary planing strake can also be provided for use as a running surface when a sharp turn is performed at high speed.

The present invention allows the inflatable collar to be mounted to the sides of the boat hull in such a way that water pressure at high speeds does not force the inflatable collar away from the boat hull, thus preventing damage to the boat hull or inflatable collar. Furthermore, the inflatable collar is mounted to the hull without holes being formed in the sides of the boat, thus ensuring that mounting the inflatable collar on the hull does not create a possibility of leaks into the interior of the boat.

An embodiment of an inflatable collar with foam inserts watercraft includes a rigid, planing hull having a transom and a pair of curved sides extending forwardly from the transom to form the bow of the watercraft. The sides and the bottom of the hull are joined to form a chine. A single continuous inflatable collar with foam inserts for stabilizing the watercraft is mounted on the sides of the hull above the chine and extends continuously from the transom along the length of the hull to the bow and back to the transom along the opposite side of the hull. The inflatable collar extends outwardly from the sides of the hull so that it contacts and displaces an increasing volume of water as the boat lists. This stabilizes the boat by increasing the righting moment of the hull. The watercraft may include a flange that extends outwardly from the sides of the hull. The flange is adapted to extend below the inflatable collar to ensure that water does not flow between the inflatable collar and the sides of the hull.

The above and other features of the invention, including various novel details of construction and accommodation of parts, will now be more particularly described with reference to the accompanying drawings. It will be understood that the particular device embodying the invention is shown by way of illustration only, and not as a limitation of the invention. Principles and features of this invention may be employed in various and numerous embodiments without departing from the scope of the invention.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
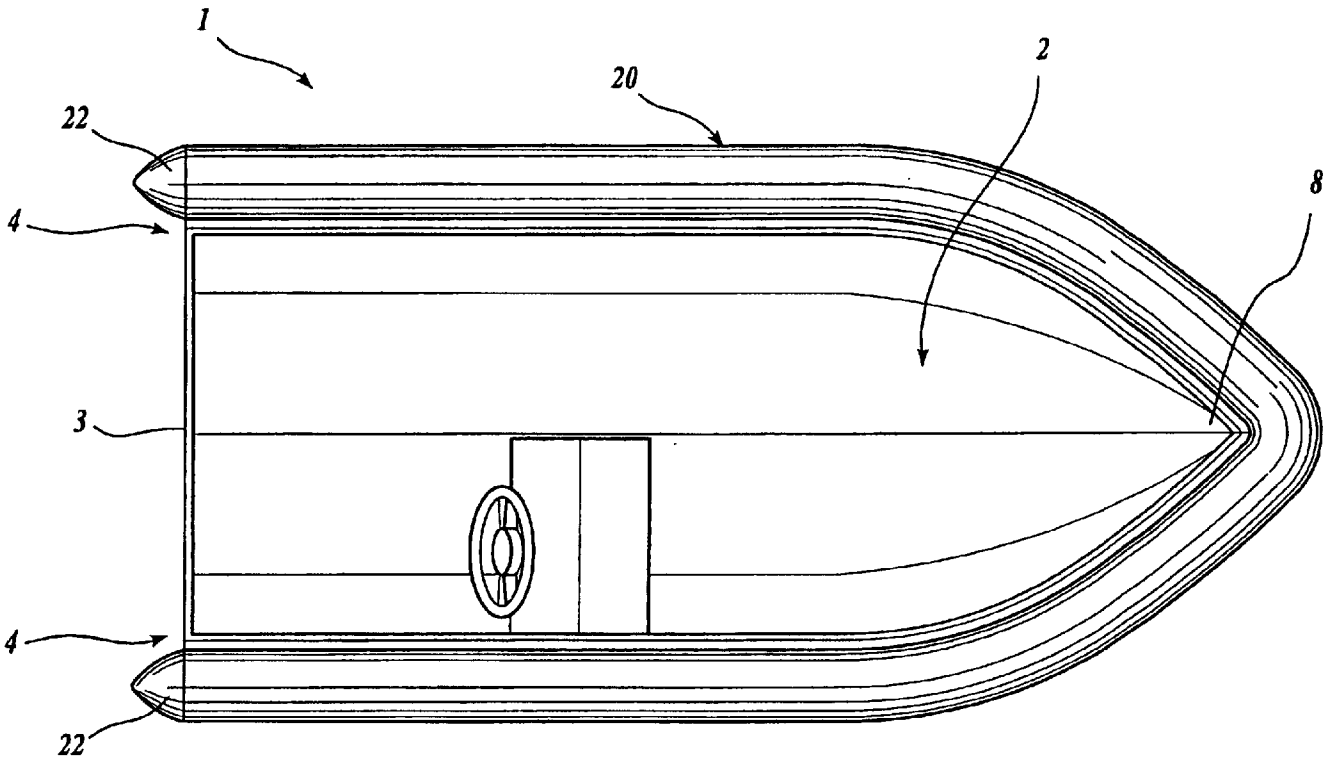
FIG. 1 is a first embodiment of a watercraft stabilized by an inflatable collar partially filled with foam inserts.
Figure 2:
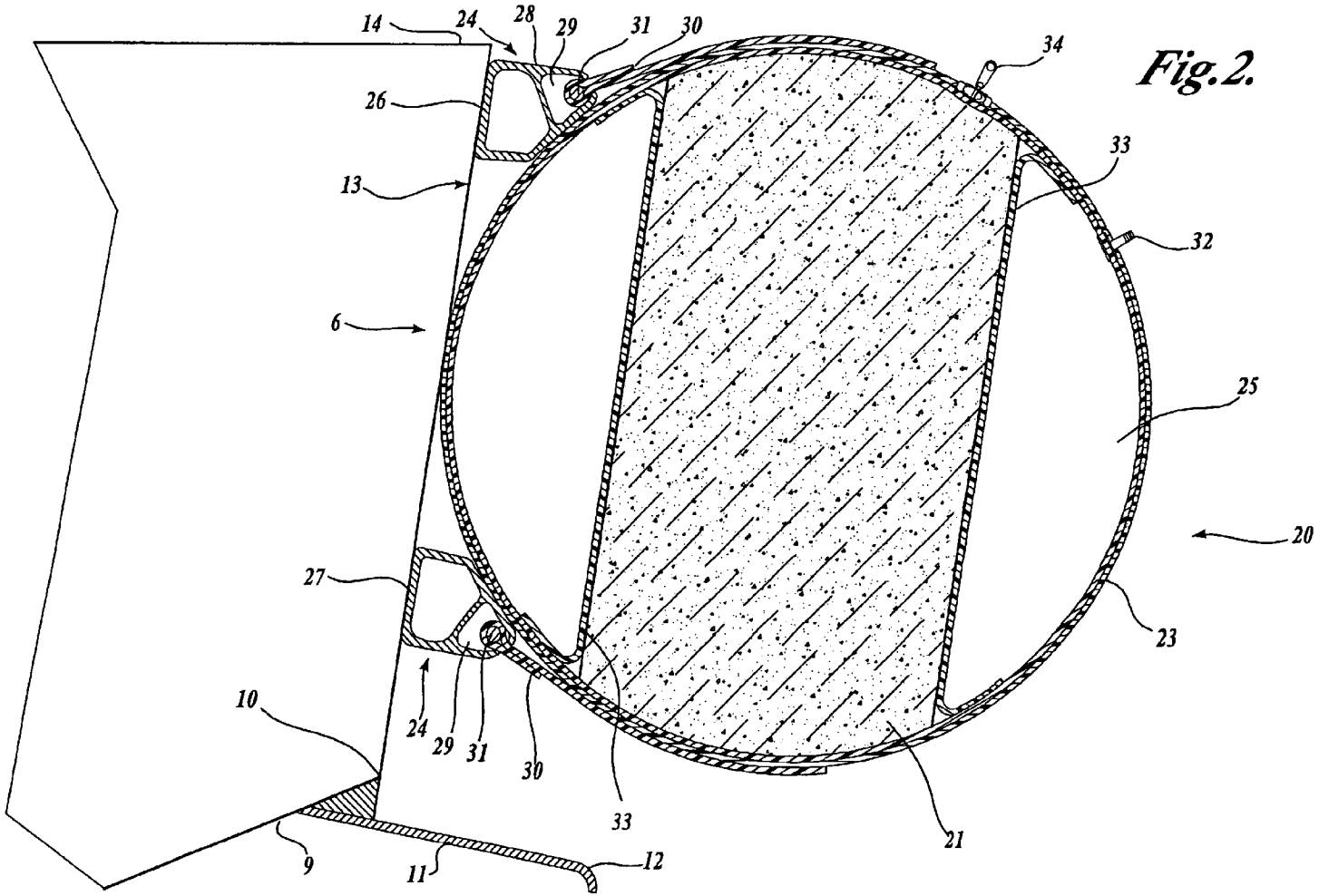
FIG. 2 is a cross-sectional view of the inflatable collar with foam insert of FIG. 1.

Referring to FIGS. 1 and 2, an embodiment of a watercraft 1 stabilized by an inflatable collar 20 partially filled with foam inserts 21 is disclosed. In the first embodiment disclosed, the watercraft 1 includes a rigid hull 2 and single inflatable collar 20 located on both sides of the hull. The rigid hull 2 may be formed of aluminum, fiberglass, Kevlar®, or any other suitable material that can withstand the harsh and corrosive environment encountered by boat hulls. In the embodiment shown, the hull 2 is designed to be a high-performance boat hull. The hull 2 includes a transom 3 that defines the stern of the boat, two sides 6 extending forward from the stem and curving toward each other to define the bow 8 of the boat hull, and a bottom 9. In the embodiment shown in FIGS. 1 and 2, the sides 6 are joined to the bottom 7 of the boat and to the sides 4 of the transom 3 such that hard chines 10 are formed at the intersection between the sides 6 and the bottom 9 of the boat 1. A hard chine is formed when two discrete surfaces meet at an angle, as opposed to a soft chine where the chine is part of a gradually curving surface, such as the surface of a number of sailboat hulls. In the embodiment shown, auxiliary planing strakes 11 extend outwardly and downwardly from the bottom 9 of the hull 2 near chines 10. The outwardmost edges 12 of the auxiliary planing strakes 11 curve downwardly. Auxiliary planing strakes 11 downwardly deflect water or debris thrown off by the bottom 9 of the hull 2 as the boat 1 moves through the water, thereby protecting the inflatable collar 20 from damage. In order to increase safety while gaining unique performance advantages, an inflatable collar 20 with foam inserts 21 is mounted to the sides 6 of the hull 2 above the chines 10. Mounting the inflatable collar 20 above the chines 10, as opposed to at or below the chines, creates a number of advantages as explained below. The inflatable collar 20 extends from a point rearward of the transom 3 forward along one of the sides 6 of the hull 2 to the bow 8 of the boat, and then extends rearward along the opposite side of the hull, as is best shown in FIG. 1. The inflatable collar 20 may include rear extensions 22 that extend rearwardly beyond the transom 3 in order to provide additional lift in head and following seas, thus increasing the stability of the boat 1. Although it could be advantageous to extend the inflatable collar 20 beyond the transom 3, it will be understood that it is not a required aspect of the present invention to do so.

Figure 3:
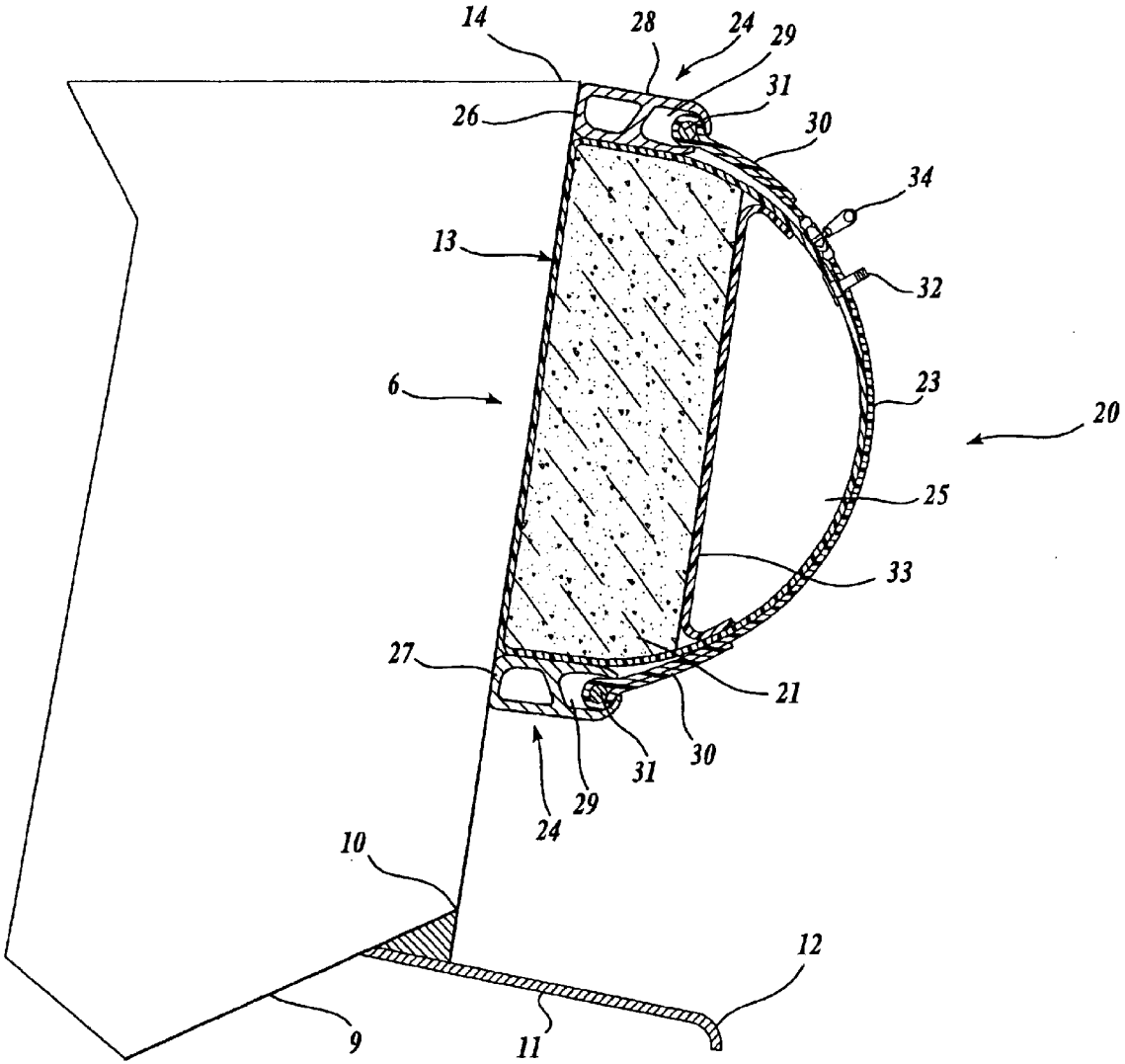
FIG. 3 is a cross-sectional view of another embodiment of the inflatable collar with foam inserts.
Figure 4:
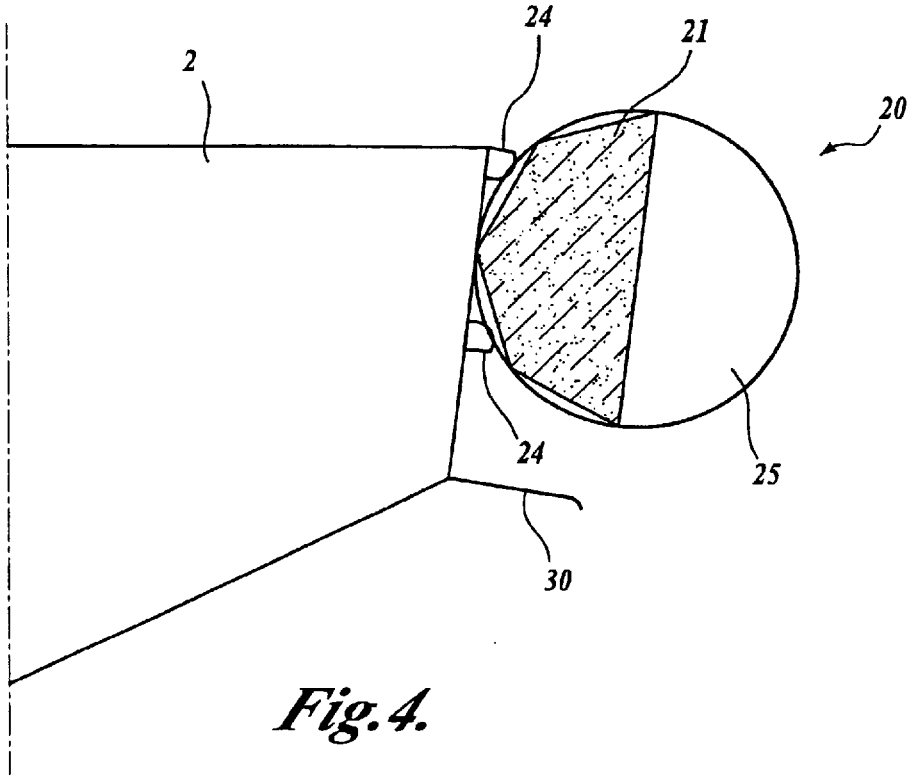
FIG. 4 is a cross-sectional view of a third embodiment of the inflatable collar with foam inserts.

In the embodiment shown in FIG. 2, the inflatable collar 20 is substantially cylindrical in cross section. Other embodiments of the collar 20 are shown in FIGS. 3 and 4. The inflatable collar 20 includes a unitary outer cover 23, attachment mechanism 24, and multiple air bladders 25 contained within the outer cover. The attachment mechanism 24 for the inflatable collar 20 includes upper 26 and lower 27 extruded attachment fittings attached to each side 6 of the hull 2. In an embodiment, the extruded attachment fittings 26 and 27 are made of aluminum, but may be formed of fiberglass, Kevlar®, or any other suitable material that can withstand the harsh and corrosive environment encountered by boat hulls. In an embodiment of the invention in which the hull 2 and extruded attachment fittings 26 and 27 are aluminum or another metal, the extruded attachment fittings are attached by welding. Suitable attachment techniques are known to those skilled in the art with respect to nonmetal hulls or extruded attachment fittings. Each extruded attachment fitting 26 and 27 runs continuously from the transom 3 to a point several inches from the stem of the bow 8. In the embodiment shown, the upper extruded attachment fittings 26 on each side 6 of the hull 2 are mounted so that their upper surface 28 is flush with the tops 13 of the sides 6 of the boat, while the lower extruded attachment fittings 27 are mounted several inches above the chine 10. The extruded attachment fittings 26 and 27 include lipped channels 29, as shown in FIG. 3. The ends of the lipped channels 29 at the transom 3 are permanently blocked off, while the ends of the lipped channels near the bow are blocked by any suitable removable fitting.

The outer cover 23 is made of polyurethane or any other flexible material that can withstand the harsh and corrosive environment encountered by boat hulls. The outer cover 23 of the inflatable collar 20 includes flaps 30 of material disposed on the inward side of the inflatable collar. The flaps 30 are wrapped around ultra high molecular polyethylene rods 31, and the combination of rod and flap material is sized to slide in the end of the extruded attachment fittings 26 and 27, but is too large to pull through the open sides of the lipped channels 29. The inflatable collar 20 may be placed on the hull 2 by removing the removable fitting blocking the forward end of the lipped channels 29, sliding the rods 31 and attached flap 30 material down the length of the lipped channels, and closing the forward end of the channel by replacing the removable fitting.

Referring to FIG. 4, the inflatable collar 20 and flaps 30 can be sized and positioned so that when the collar is inflated, it will protrude above the gunwales 14, providing a wide and comfortable sitting location. The inflatable collar 20 and flaps 30 can also be sized and positioned so that the collar is in contact with the water when the vessel is not underway, or positioned so that the collar is not in contact with the water when the vessel is not underway.

Referring to FIGS. 2-3, the inflatable collar 20 is further fitted with one or more internal air bladders 25. The internal air bladders 25 are made of any air- and watertight flexible material that can withstand the harsh and corrosive environment encountered by boat hulls, such as polyurethane. Each internal air bladder 25 further includes a resealable air valve 32 that can be used for inflating or deflating the air bladder. Each internal air bladder 25 is further fitted with a foam insert 21 so that the inflatable collar 20 retains some capacity to displace water in the event that the internal air bladders 25 lose air- and watertight integrity. In the embodiment shown in FIG. 3, the foam insert 21 is held in position within the internal air bladder 25 by a panel 33 of the material used to form the air bladder. The outer cover 23 optionally includes zipper 34, which can be opened to permit the easy removal and/or replacement of the air bladders 25. Removal of the air bladders 25 reduces the width of the boat 1, permitting easier over-the-road transport. As another alternative, air bladders 25 can be drained of air through resealable air valve 32 to also reduce the width of the boat 1, whether or not the outer cover 23 is fitted with zipper 34.

The reserve buoyancy foam insert 21 can be formed of any suitable buoyant foam that can withstand the harsh environment encountered by a high-speed watercraft, including normal docking and moorage bumping. It is also advantageous that the foam insert 21 be formed from a foam that does not absorb water, has some memory, and is low in density. In the preferred embodiment shown, a closed-cell polypropylene or polyethylene foam having a density of 1.7 pounds per cubic foot is used to form the foam insert 21. In view of currently available foam, it is believed that an optimum range of densities is from approximately 1–3 pounds per cubic foot. Advances in technology may result in lower density foam that can be employed in the invention. The foam insert 21 in the current embodiment is sized to displace one-half to two-thirds of the volume of water displaced by an intact internal air bladder 25. However, the foam insert 21 can be sized to provide any fraction of displacement relative to an intact internal air bladder 25, but should be sized so that the boat 1 retains a sufficient righting moment for its intended purpose, even when the internal air bladders have lost their water- and air-tight integrity. The foam inserts 21 may also be sized to provide the boat 1 with sufficient buoyancy to ensure that the boat will float even if filled with water or capsized.

Placing the inflatable air collar 20 above the chine 10 of the hull 2 also creates performance advantages. The use of a rigid planing hull 2 in the present invention allows the inflatable collar 20 to be lifted substantially out of contact with the surface of the water during high-speed operation. This greatly reduces the wetted surface area and, therefore, the drag of the boat 1. Furthermore, the foam insert 21 allows the boat 1 to retain a high degree of stability in the event the air bladders 25 lose water- and air-tight integrity. The illustrative embodiment is also ideally suited for use in locations where the boat 1 may come into contact with other objects. In those circumstances, the inflatable collar 20 will deform without damaging the object that has been struck or injuring any persons who have been struck.

Figure 5:
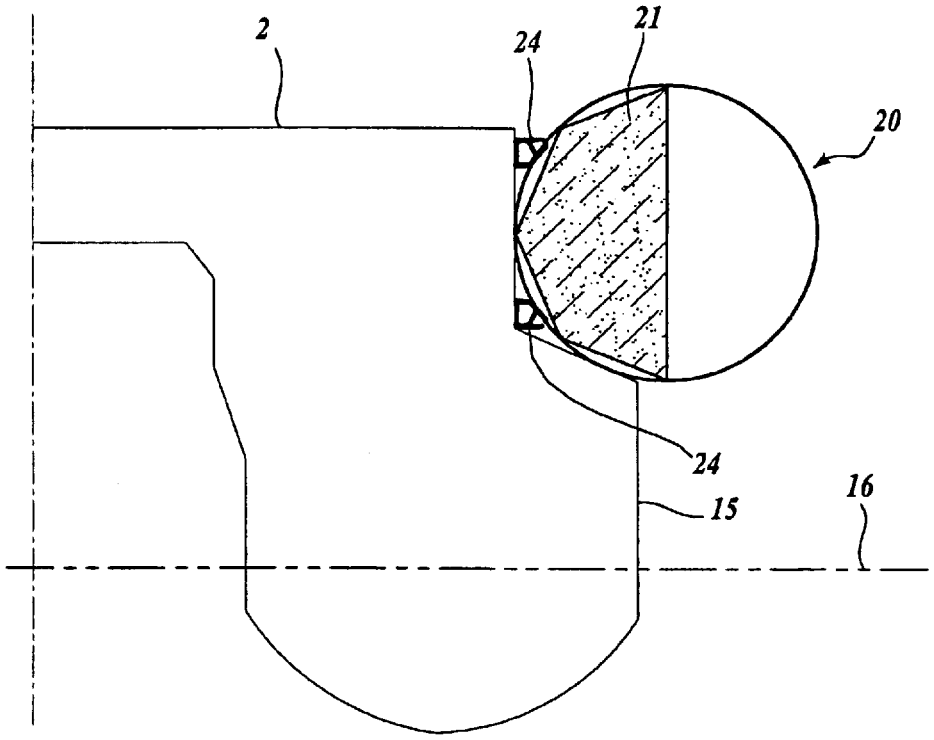
FIG. 5 is a cross-sectional view of a fourth embodiment of the inflatable collar with foam inserts.

Referring to FIG. 5, another embodiment is shown wherein the hull 2 is a catamaran. In the embodiment shown, the inflatable air collar 20 is mounted to the outwardmost side of each hull sponson 15 above the static waterline 16. As with the inflatable air collar 20 mounted to the mono-hull, the collar can otherwise have any of the embodiments described above.

It is understood that the present invention is by no means limited to the particular construction herein disclosed and/or shown in the drawings, but also comprises any modifications or equivalents within the scope of the disclosure.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A watercraft comprising:

a rigid hull having a transom, a bottom, and a pair of sides extending forwardly from the transom to form the bow of the hull;

a stabilizing collar mounted on an outboard side of the sides of the rigid hull, the stabilizing collar having an inboard bladder defining a first volume and an outboard bladder defining a second volume, the inboard and outboard bladders being separated by a panel; and mounting means for holding the foam stabilizing means to the sides of the hull without forming holes in the hull;

wherein the first volume is substantially filled with a foam insert and the second volume is substantially filled with air.

2. The watercraft of claim 1, wherein the stabilizing collar extends continuously from the bow to the transom.

3. The watercraft of claim 2, wherein the sides of the hull join to the bottom of the hull in a hard chine, and wherein the stabilizing collar extends from the top of the hull side most of the way to the hard chine.

4. The watercraft of claim 1, further comprising an upper attachment member fixedly attached to an upper portion of the sides of the hull, a lower attachment member fixedly attached to a lower portion of the sides of the hull, and an outer cover that wraps about the stabilizing collar and engages the upper and lower attachment members, to releasably secure the stabilizing collar to the watercraft.

5. The watercraft of claim 4, wherein at least one of the upper and lower attachment members includes an elongate lipped channel, and further, wherein the outer cover includes a rod sized to be slidably insertable into the elongate lipped channel.

6. The watercraft of claim 1, wherein the outboard bladder further comprises an air valve for inflating the outboard bladder.

7. The watercraft of claim 6, wherein the inboard bladder further comprises an elongate, releasable closure to facilitate insertion of the foam insert.

8. The watercraft of claim 7, wherein the releasable closure is a zipper.

9. The watercraft of claim 1, wherein the foam insert is formed from a closed cell foam having a density between about 1 and 3 pounds per cubic foot.

10. The watercraft of claim 1, wherein the foam insert displaces between about one-half and two-thirds of the volume of the, stabilizing collar.

11. The watercraft of claim 1, wherein the foam insert is sized to provide sufficient buoyancy to ensure that the watercraft will float, even if filled with water.

12. An improved boat of the type having a planing rigid hull including a transom, a bottom, and a pair of sides extending forwardly from the transom to form the bow of the hull, the improvement comprising:

a stabilizing collar mounted along an outboard surface of the sides of the hull, the stabilizing collar having an inboard bladder that is substantially filled with foam, and an outboard bladder that is inflated with air, the first and second bladders being separated by a flexible panel; and a flexible cover that wraps about the stabilizing collar, the flexible cover releasably attachable to the sides of the hull to attach the stabilizing collar to the boat.

13. The improved boat of claim 12, wherein the stabilizing collar extends continuously from the bow to the transom.

14. The improved boat of claim 13, wherein the sides of the hull join to the bottom of the hull in a hard chine, and wherein the stabilizing collar extends from the top of the hull side most of the way to the hard chine.

15. The watercraft of claim 12, further comprising an upper attachment member fixedly attached to an upper portion of the sides of the hull, a lower attachment member fixedly attached to a lower portion of the sides of the hull, and wherein the outer cover engages the upper and lower attachment members to releasably secure the stabilizing collar to the watercraft.

16. The watercraft of claim 15, wherein at least one of the upper and lower attachment members includes an elongate lipped channel, and further, wherein the outer cover includes a rod sized to be slidably insertable into the elongate lipped channel.

17. The watercraft of claim 12, wherein the outboard bladder further comprises an air valve for inflating the outboard bladder.

18. The watercraft of claim 17, wherein the inboard bladder further comprises an elongate releasable closure to facilitate insertion of the foam.

19. The watercraft of claim 18, wherein the releasable closure is a zipper.

20. The watercraft of claim 12, wherein the foam is formed as an elongate insert from a closed cell foam having a density between about 1 and 3 pounds per cubic foot.

21. The watercraft of claim 12, wherein the foam displaces between about one-half and two-thirds of the volume of the stabilizing collar.

22. The watercraft of claim 12, wherein the quantity of foam is sufficient to provide buoyancy to ensure that the watercraft will float even if filled with water.

* * * * *

UNITED STATES PATENT AND TRADEMARK OFFICE

CERTIFICATE OF CORRECTION

PATENT NO. : 6,810,827 B2
DATED : November 2, 2004
INVENTOR(S) : W. M. Hansen

It is certified that error appears in the above-identified patent and that said Letters Patent is hereby corrected as shown below:

Title page,
Item [56], References Cited, FOREIGN PATENT DOCUMENTS, delete as duplicative "GB 2 196 717 A 5/1988"
Item [74], *Attorney, Agent or Firm*, "O'Connor;" should read -- O'Connor --

Column 6,
Line 16, "of the, stabilizing" should read -- of the stabilizing --

Signed and Sealed this

First Day of March, 2005

JON W. DUDAS
*Director of the United States Patent and Trademark Office*